US005263850A

United States Patent [19]

Walker

[11] Patent Number: 5,263,850

[45] Date of Patent: Nov. 23, 1993

[54] EMISSION CONTROL SYSTEM FOR AN OIL-FIRED COMBUSTION PROCESS

[75] Inventor: Thomas J. Walker, Norwood, Mass.

[73] Assignee: Boston Thermal Energy Corporation, Boston, Mass.

[21] Appl. No.: 831,807

[22] Filed: Feb. 5, 1992

[51] Int. Cl.[5] ..... F23D 11/44

[52] U.S. Cl. ..... 431/11; 431/12; 431/208

[58] Field of Search ..... 431/11, 4, 10, 5, 208, 431/207, 12, 13, 2

[56] References Cited

U.S. PATENT DOCUMENTS

| | | | |
|---|---|---|---|
| 3,589,314 | 6/1971 | Tratz | 431/208 X |
| 3,890,084 | 6/1975 | Voorheis et al. | 431/10 |
| 3,949,595 | 4/1976 | Jones et al. | 73/35 |
| 3,999,959 | 12/1976 | Bajek | 44/2 |
| 4,059,385 | 11/1977 | Gulitz et al. | 431/12 |
| 4,059,535 | 11/1977 | De Vault et al. | 252/33 |
| 4,101,293 | 7/1978 | Krause et al. | 44/51 |
| 4,249,885 | 2/1981 | Reich | 431/208 X |
| 4,328,546 | 5/1982 | Kreft et al. | 364/424 |
| 4,333,739 | 6/1982 | Neves | 44/52 |
| 4,393,817 | 7/1983 | Lindberg | 123/3 |
| 4,393,854 | 7/1933 | Tacquet | 123/514 X |
| 4,409,931 | 10/1983 | Lindberg | 123/25 |
| 4,413,593 | 11/1983 | Resler, Jr. | 123/1 A |
| 4,453,502 | 6/1984 | Resler, Jr. | 123/1 R |
| 4,460,328 | 7/1984 | Niederholtmeyer | 431/12 X |
| 4,476,817 | 10/1984 | Lindberg | 123/3 |
| 4,541,367 | 9/1985 | Lindberg | 123/25 M |
| 4,542,704 | 9/1985 | Brown et al. | 110/347 |
| 4,568,248 | 2/1986 | Harders | 417/43 |
| 4,576,570 | 3/1986 | Adams et al. | 431/12 |
| 4,582,005 | 4/1986 | Brown | 110/347 |
| 4,618,323 | 10/1986 | Mansour | 431/177 |
| 4,639,255 | 1/1987 | Schuettenberg et al. | 44/62 |
| 4,676,885 | 6/1987 | Bush | 208/49 |
| 4,684,372 | 8/1987 | Hayes et al. | 44/51 |
| 4,696,638 | 9/1987 | DenHerder | 431/4 |
| 4,761,270 | 8/1988 | Turchan | 423/235 |
| 4,815,965 | 3/1989 | Likins, Jr. | 431/12 |
| 4,821,757 | 4/1989 | Hayes et al. | 137/13 |
| 4,851,201 | 7/1989 | Heap et al. | 423/235 |
| 4,861,567 | 8/1989 | Heap et al. | 423/235 |
| 4,943,421 | 7/1990 | Turchan | 423/235 |
| 4,955,326 | 9/1990 | Helmich | 123/27 GE |
| 4,968,396 | 11/1990 | Harvey | 204/131 |
| 5,004,480 | 4/1991 | Kanne | 44/387 |
| 5,066,470 | 11/1991 | Lo | 423/242 |

FOREIGN PATENT DOCUMENTS

| | | | |
|---|---|---|---|
| 0132825 | 11/1978 | Japan | 431/18 |
| 0126519 | 7/1985 | Japan | 431/18 |

*Primary Examiner*—Carl D. Price

*Attorney, Agent, or Firm*—Weingarten, Schurgin, Gagnebin & Hayes

[57] ABSTRACT

A system for the for the control of exhaust gas emissions, such as $NO_x$ and $SO_x$, from an oil-fired burner is disclosed. In the system, a heavier, less expensive grade of fuel oil, such as #6 oil, is burned, and the emissions from the burner are continuously monitored. If the concentration of $NO_x$ and/or $SO_x$ in the exhaust gas is greater than a predetermined threshold concentration, a lighter, more expensive grade of fuel oil, such as #2 oil, is blended with the heavier oil to reduce the concentration of $NO_x$ and/or $SO_x$. A control valve in the lighter grade fuel oil line is controlled automatically in response to the measured concentration of $NO_x$ and/or $SO_x$ to blend into the heavier oil only the necessary amount of lighter oil. Thus, if the concentration of $NO_x$ and/or $SO_x$ in the exhaust gases from the blended oils is less than the predetermined threshold concentration, less of the lighter oil is blended with the heavier oil. In this manner, a cost efficient use of available fuel oils is obtained and predetermined exhaust gas limits are achieved.

19 Claims, 3 Drawing Sheets

EMISSION CONTROL SYSTEM FOR AN OIL-FIRED COMBUSTION PROCESS

FIELD OF THE INVENTION

This invention relates to oil-fired combustion systems and more particularly to a system for controlling emissions from oil-fired burners.

BACKGROUND OF THE INVENTION

Industrial power plants typically burn fossil fuels, such as fuel oils, to generate power. However, the exhaust gases resulting from the combustion of fossil fuels contain harmful pollutants, such as oxides of nitrogen, $NO_x$ (primarily NO and $NO_2$), or sulfur, $SO_x$ (primarily $SO_2$). These emissions have been linked with harmful effects such as acid rain. Accordingly, environmental regulations provide maximum limits on the concentrations of certain gases that may be present in the exhaust gases from various combustion processes.

Fuel oils are graded by the American Society for Testing and Materials (ASTM) according to their specific gravity and viscosity, #1 being the lightest and #6 the heaviest. #6 oil is relatively less expensive than the other grades of oil, so it is the least expensive to burn. However, #6 oil has a relatively higher content of sulfur and nitrogen, which results in a higher concentration of nitrogen oxides and sulfur dioxide in the exhaust gases from the combustion of the oil. The actual nitrogen ,or sulfur content varies somewhat within each grade of oil.

Systems for controlling $NO_x$ emissions have been employed to reduce pollution and meet environmental requirements. For example, systems have been devised to control the ratio of air to fuel during combustion to reduce the formation of $NO_x$ during combustion. Scrubbers to remove $SO_x$ may be placed in the exhaust stream.

SUMMARY OF THE INVENTION

The present invention provides a feedback system for controlling the emissions present in the exhaust stream of an oil-fired combustion process without the need for costly additional devices. The system has particular application to steam generation plants.

In the present invention, two oil storage tanks are provided. One tank stores a heavier oil, such as #6 oil, and the other tank stores a lighter oil, such as #2 oil. #6 oil is pumped to the burner and burned. A continuous emissions monitor measures the concentration of gases, such as $NO_x$, in the exhaust gas stream from the burner. If the concentration of $NO_x$ is greater than a predetermined threshold, then #2 oil is blended with the #6 oil until the concentration of $NO_x$ is brought down to the predetermined threshold. A controller in communication with the continuous emissions monitor operates a control valve in the line from the #2 oil tank to admit only as much #2 oil as is needed to maintain the emissions concentration no greater than the predetermined threshold.

DESCRIPTION OF THE DRAWINGS

The invention will be more fully understood from the following detailed description taken in conjunction with the accompanying drawings in which.

DETAILED DESCRIPTION OF THE INVENTION

Figure 1:
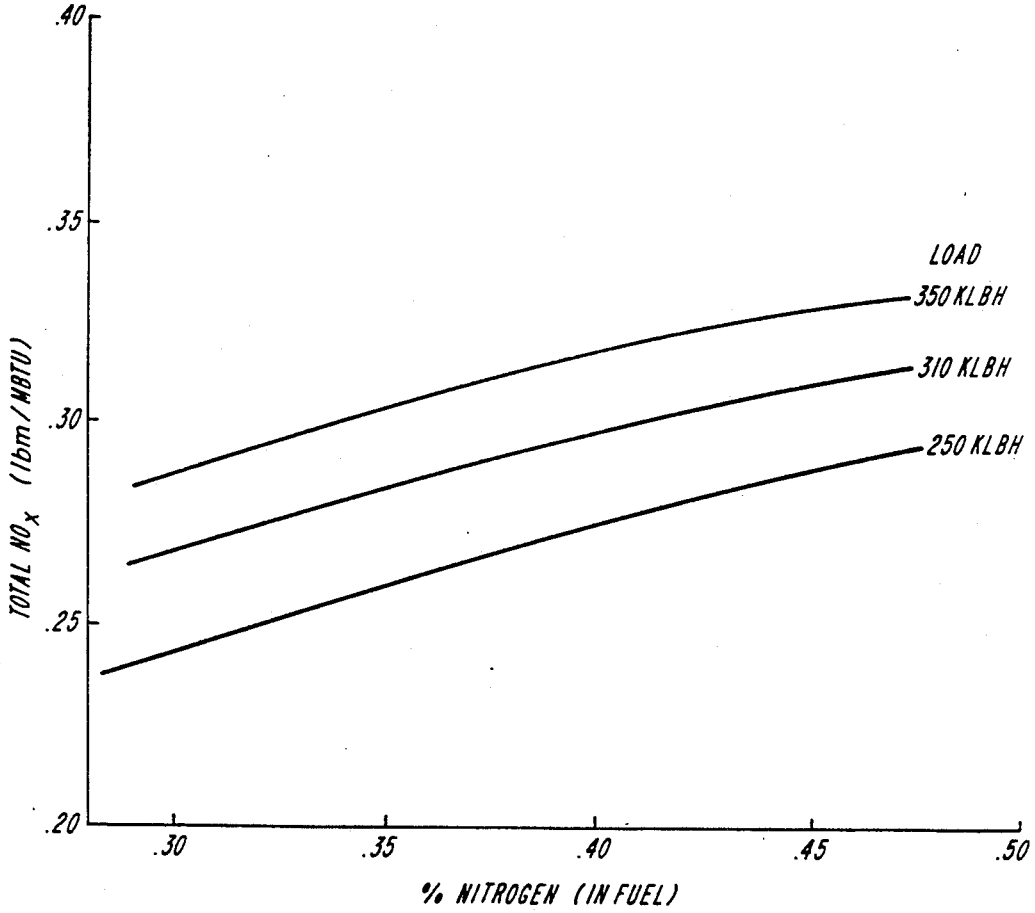
FIG. 1 is a graph illustrating an experimentally determined relationship between the concentration of $NO_x$ emissions and fuel N content for various boiler loads.

The relationship between the concentration of $NO_x$ in the exhaust gas and the fuel nitrogen content by weight percent has been experimentally determined as a function of boiler load, as shown in FIG. 1. The amount of $NO_x$, or $SO_x$, present in the exhaust gases depends in part on the amount of nitrogen, or sulfur, present initially in the fuel oils. The heavier grades of oil generally have more nitrogen and sulfur. The lighter grades of oil, which have less nitrogen and sulfur, are, however, more expensive to burn. Thus, using a lighter grade of oil results in reduced $NO_x$ or $SO_x$ emissions, but a more expensive combustion process. The amount of $NO_x$ or $SO_x$ also depends on the load on the boiler. The values in FIG. 1 are representative of a particular boiler; however, a similar relationship exists for all boilers.

Figure 2:
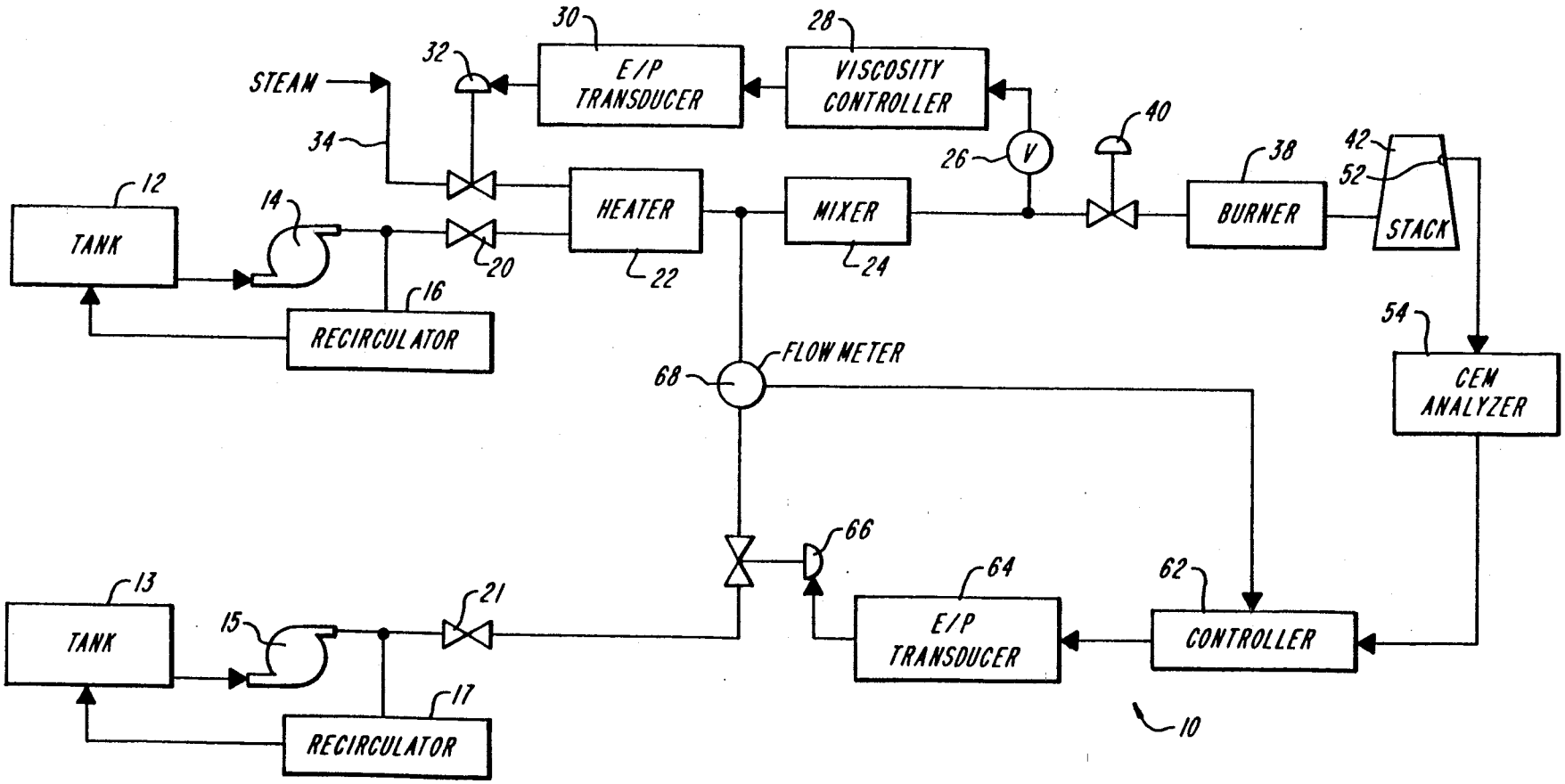
FIG. 2 is a schematic diagram of the system of the present invention.

The present invention relates to a feedback system for controlling emissions derived from the relationship shown in FIG. 1. An exemplary embodiment of the emission control system of the present invention is shown generally at 10 in FIG. 2. The system is shown and described in conjunction with $NO_x$ emissions from an oil-fired steam boiler for a steam generation plant, although it may be employed for $SO_x$ emissions and for any process in which oil fuels are burned.

An oil tank 12 is provided for storage of a heavier grade of fuel oil, such as #6 oil. The #6 oil is pumped by a pump 14 out of the tank 12. A recirculator 16 returns any excess oil back to the tank.

The #6 oil to be burned passes through a valve assembly 20 to the fuel oil heater 22, which may be heated using steam from the steam generating system. #6 oil is relatively viscous at typical storage temperatures and frequently must be preheated for efficient pumping and/or burning. For example, in burning fuel oil in a boiler unit, it is usually necessary to atomize the oil to increase the surface area of the oil particles exposed to the combustion air. The greater surface area exposure speeds up ignition and combustion. For good atomization, heavier grades of oil generally must be preheated to reduce the viscosity. The viscosity of the oil is controlled by a viscosity control assembly to be described more fully below.

Downstream of the heater, the oil passes through a mixer 24 where the heavier oil may be mixed with a lighter oil to achieve a blend. The mixer 24 preferably comprises a static or motionless in-line mixer in which a series of baffles are formed inside a portion of the flow line. Although other means for achieving a mixing of the fuel oils may be provided, a static mixer is advantageous in that no additional power is required to operate the mixer. Suitable static mixers are available from several vendors, such as Komax Systems, Inc., EMI Incorporated, TAH Industries, Inc., Gelber Industries, and KOFLO Corporation.

A second fuel oil storage tank 13 is provided for storage of a lighter fuel oil, such as #2 oil. The #2 oil is pumped by pump 15 out of the tank 13. Recirculator 17 returns any excess oil back to the tank. The #2 oil to be burned passes through a valve assembly 21, a control valve 66, and flow meter 68, to the inlet of the mixer 24. The amount of #2 oil to be blended with the #6 oil is controlled by the valve 66 and flow meter 68 in a manner to be described more fully below.

The viscosity control assembly includes a viscometer 26 which measures the viscosity of the oil downstream of the mixer 24. Lighter oils have a lower viscosity and, if such an oil is blended into the heavier oil, the viscosity of the blend is lower than the viscosity of the heavier oil alone. The viscometer 26 measures the viscosity of the oil converts the viscosity to an electrical signal, and transmits the signal to a viscosity controller 28. The controller compares the measured viscosity to the required viscosity and determines whether any temperature adjustments should be made to the oil heater 22 to achieve the desired viscosity. The viscosity controller transmits a signal representative of the temperature change to an electric-to-pneumatic transducer 30. The transducer 30 converts the electrical signal from the controller to a pneumatic signal for operation of a pneumatic control valve 32 in a steam line 34. By admitting more or less steam through the valve as determined by the controller 28, the heater temperature is regulated to provide the desired heating of the oil. Suitable viscometers and viscosity controllers are available from several manufacturers, such as Norcross Corporation. Similarly, suitable electric-to-pneumatic transducers are available from several manufacturers, such as Fisher Controls International, Inc., or Moore Products Co. Other means for controlling the viscosity may be used, such as the addition of a solvent and/or other ingredients, if desired.

One or more burners 38 is provided downstream of the viscosity control assembly for burning the oil to generate steam in a boiler. The burner(s) may be of any suitable design for the particular combustion process of interest. A pressure regulating valve 40 regulates the pressure of the oil admitted to the burner to regulate the burner load. To increase the boiler load, the pressure of the oil introduced to the burner is increased. Conversely, to decrease boiler load, the pressure is decreased.

The exhaust gases from the burner(s) are directed to a stack 42. From the stack 42, the gases are released to the atmosphere. A continuous emission monitor (CEM) is provided to monitor the content of the exhaust gases. The CEM measures the concentration of the particular exhaust gases of interest. Typically, in an oil-fired steam generating plant, the CEM monitors the concentration of gases such as $NO_x$ and $O_2$, as well as measuring the opacity, or density, of the exhaust gas. The concentration of $SO_x$ is frequently of concern in many oil-fired processes also. The concentration of other components, such as hydrocarbons, may be monitored as well.

The CEM comprises a sample probe 52 and a computer-controlled analyzer unit 54. The sample probe 52 is placed in the exhaust gas stream, generally in the stack 42, to continuously obtain samples of the exhaust gas. The probe 52 sends the samples to the analyzer unit 54 where the samples are analyzed. A pump, such as a vacuum pump, may be provided to draw the samples into and through the analyzer unit. In the analyzer unit, the gas sample flows through a filter to remove particulates. The sample is cooled and demoisturized. Any residual moisture in the sample is detected and measured using a conductivity sensor. The analyzer unit generally includes several gas analyzers for analyzing the gas for different components. Under the control of the computer, the gas is diverted through a manifold to the appropriate analyzer.

A $NO_x$ analyzer measures the concentration of nitrogen oxides in the exhaust gases. A sample of the gas is passed through an $NO_x$-to-NO converter, in which molecules of $NO_2$ are broken down into NO molecules. Next, the sample gas is mixed in a flow reactor with ozone, which may be generated for this purpose from $O_2$ in the ambient air. The reaction between the NO in the sample gas and the ozone generates a chemiluminescence having characteristic wavelengths. The chemiluminescence is passed through an optical filter and is measured by a high sensitivity photomultiplier. The output of the photomultiplier is linearly proportional to the concentration of $NO_x$ in parts per million in the sample gas. An electric signal representative of the $NO_x$ concentration is transmitted from the photomultiplier to the CEM analyzer computer.

As an alternative to the analyzer unit described above, an analyzer system using absorption spectroscopy ma be provided. In this system, a light source is mounted on one side of the stack and a detector is mounted on the opposite side. Light from the light source traverses a path through the exhaust gases in the stack. The exhaust gases absorb certain characteristic wavelengths. The resulting spectra are thus characteristic of certain gas concentrations. This system may be used to measure concentrations of $NO_x$, $SO_x$, $O_2$, and hydrocarbons.

Steam generating plants generally have a control room having a monitor or other type of display where an operator can visually monitor the operations. The CEM computer sends signals representative of the measured ga concentrations to the monitor in the control room, where they may be displayed. If desired, the value of the concentrations can be displayed in units such as lbm/MBTU, rather than or in addition to ppm.

The output from the analyzer is sent as an electrical signal to the controller 62, either directly from the CEM or via the control room The controller 62 is provided to control the blending of the lighter oil with the heavier oil to lower the $NO_x$ concentration as measured by the CEM. Accordingly, the signal representative of the $NO_x$ concentration is transmitted to the controller 62. The controller sends an electrical signal representative of the concentration of $NO_x$ to an electro-pneumatic transducer 64. The transducer converts the electrical signal representative of the $NO_x$ concentration to a pneumatic signal for the control valve 66 in the #2 oil line. For example, the controller may transmit an electrical signal ranging from a low value of 4 mA to a high value of 20 mA DC. The transducer converts the electrical signal input to a pneumatic signal output ranging from 3 to 15 psig. At 3 psig, the control valve is closed. At 15 psig, the control valve is fully open. The controller 62 monitors the flow of #2 oil by a flow meter 68 downstream of the control valve 66. Combustion process controllers are commercially available from manufacturers such as Moore Products, Co., and may be configured by the purchaser to perform the desired control function, such as operation of a control valve. Similarly, electric-to-pneumatic transducers, control valves, and flow meters are commercially readily available.

The #2 oil is pumped by the pump 15 out of the tank 13. The recirculator 17 returns any excess oil back to the tank. The remaining oil passes through a valve assembly 21 to the control valve 66.

Control valve 66 allows only as much #2 oil to pass to the in-line mixer 24 as is needed to mix with the #6 oil to bring the level of $NO_x$ emissions down to the desired level. If the concentration of $NO_x$ is greater than a predetermined threshold, then #2 oil must be blended with the #6 oil to bring the concentration of $NO_x$ down to the predetermined level. The control valve is opened to allow some #2 oil into the line. The #2 oil mixes with the #6 oil in the static mixer. The exhaust gases in the stack are continuously monitored by the CEM, which continuously sends a signal representative of the measured concentration to the controller 62. The controller continues to cause the control valve 66 to open to allow more #2 oil to flow until the measured concentration of $NO_x$ reduces to the predetermined level.

When the concentration of $NO_x$ reaches the predetermined threshold, the controller 62 sends a signal to the control valve 66 to cease allowing any further #2 oil to blend with the #6 oil. If the measured concentration of $NO_x$ is below the predetermined threshold, the controller 62 causes the control valve 66 to close line from the #2 oil tank to reduce the amount of #2 oil blended with the #6 oil.

Figure 3:
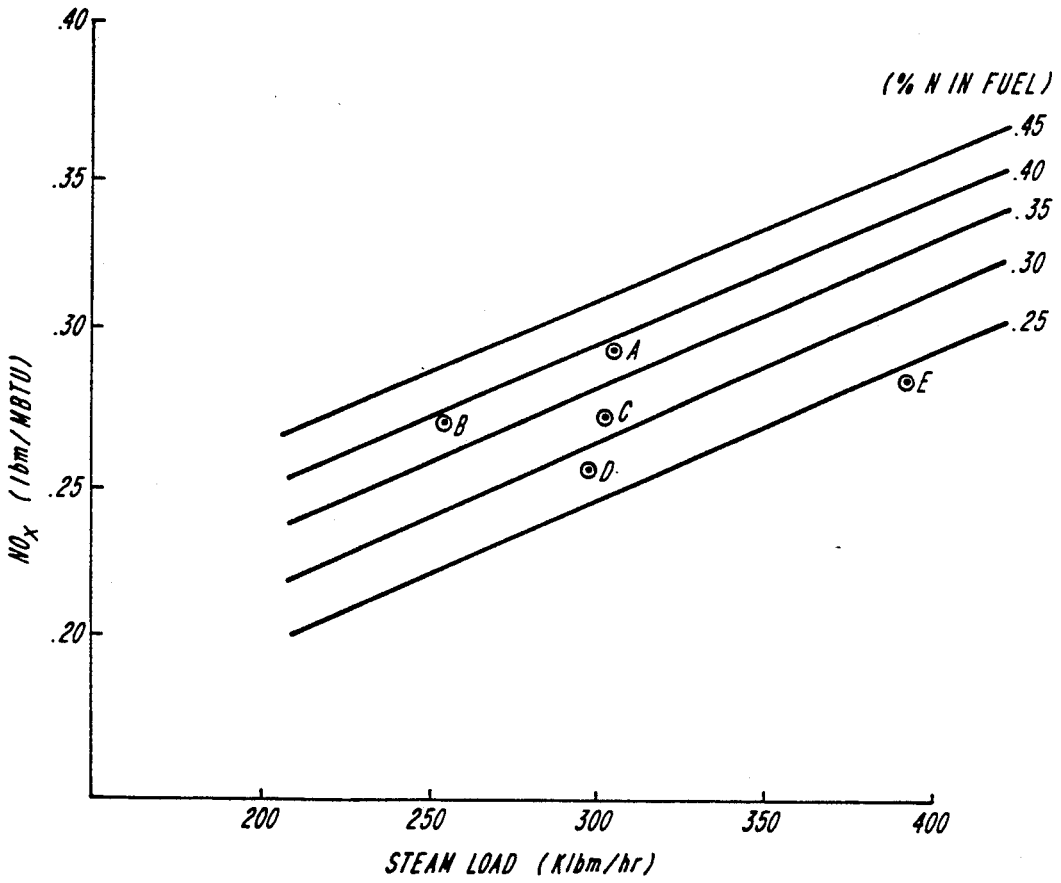
FIG. 3 is a graph illustrating results obtained using the present invention.

FIG. 3 shows the results of experiments performed to reduce $NO_x$ emissions by blending #2 oil having 0.02% N with #6 oil having 0.39% N at selected boiler loads. Points A and B were obtained by burning 100% #6 oil. Points C, D, and E were obtained by blending #6 oil with #2 oil. Point C is a blend of approximately 15% #2 oil to 85% #6 oil. Point D is a blend of approximately 30% #2 oil to 70% #6 oil. Point E is a blend of approximately 40% #2 oil to 60% #6 oil. The points are overlaid on curves which illustrate how the concentration of $NO_x$ for a particular blend increases as the boiler load increases. It can be seen from points C, D, and E that the blending of #2 oil with #6 oil reduces the concentration of $NO_x$ in the emissions.

The invention is not to be limited by what has been particularly shown and described, except as indicated in the appended claims.

I claim:

1. A process for controlling emissions from an oil-fired combustion process in which a heavier fuel oil is introduced into a burner, comprising the steps of:

continuously measuring the concentration of gases in an exhaust gas stream of the combustion process;

continuously comparing the measured concentration to a predetermined concentration level;

blending a lighter fuel oil with the heavier fuel oil to form a fuel oil blend, the heavier fuel oil having a higher content of at least one of nitrogen and sulfur than the lighter fuel oil;

introducing the fuel oil blend into the combustion process;

adjusting the amount of the lighter fuel oil blended into the heavier fuel oil until the measured concentration is no greater than the predetermined concentration level;

continuously measuring viscosity of the fuel oil blend upstream of the combustion; and heating the heavier fuel oil in response to the measured viscosity to maintain a desired viscosity of the fuel oil blend.

2. The process of claim 1, wherein the measuring step comprises:

obtaining a sample of gas in the exhaust gas stream;

transmitting the sample to a gas analyzer;

analyzing the sample to obtain concentrations of gases in the sample; and generating signals representative of the measured concentrations.

3. The process of claim 2, wherein the analyzing step comprises measuring a concentration of $NO_x$ in the sample.

4. The process of claim 3, wherein the $NO_x$ concentration is measured by converting the $NO_x$ to NO and generating a chemiluminescence from a reaction of NO and ozone.

5. The process of claim 1, wherein the measuring step comprises measuring an absorption spectra of the exhaust gases.

6. The process of claim 1, wherein the blending step comprises:

controlling a valve in a flow line from a first one of the two fuel oils to permit flow of the first fuel oil; and mixing the two fuel oils.

7. A feedback system for controlling the emissions from an oil-fired burner, comprising:

an oil burner;

a first source of a heavier fuel oil having a fluid connection to the oil burner;

a second source of a lighter fuel oil having a fluid connection to the oil burner joined to the fluid connection of the first source to form a common flow path for flow of a combination of the lighter oil and the heavier oil to the burner, wherein the heavier fuel oil has a higher content of at least one of nitrogen and sulfur relative to the lighter fuel oil;

an emissions monitor operative to measure concentrations of gases in an exhaust gas stream of the oil burner and to generate signals representative of the measured concentrations;

a controller unit responsive to the signals generated by the emissions monitor and operatively connected to the second source of lighter fuel oil to introduce the lighter fuel oil to the oil burner in combination with the heavier fuel oil until the signals from the emissions monitor are representative of measured concentrations which are below a predetermined threshold concentration;

a heater for the heavier fuel oil;

a viscometer in the common flow path downstream of the heater for measuring the viscosity of fuel oil in the common flow path introduced to the burner; and a viscosity controller operatively connected to the viscometer and the heater to control the temperature of the heater in response to the measured viscosity of the fuel oil introduced to the burner.

8. The feedback system of claim 7, wherein the heavier fuel oil has a higher nitrogen content than the lighter fuel oil.

9. The feedback system of claim 7, wherein the heavier fuel oil has a higher sulfur content than the lighter fuel oil.

10. The feedback system of claim 7, wherein the heavier fuel oil is #6 oil.

11. The feedback system of claim 7, wherein the lighter fuel oil is #2 oil.

12. The feedback system of claim 7, wherein the emissions monitor comprises:

a probe located in the exhaust stream of the oil burner to collect samples of exhaust gases, an analyzer unit having a plurality of gas analyzers, and a controller operatively connected to the probe and the analyzer unit to direct the gas samples from the probe to the gas analyzers in the analyzer unit and to receive signals from the analyzer unit representative of the measured concentrations.

13. The feedback system of claim 12, wherein at least one of the gas analyzers is operative to determine the concentration of nitrogen oxides in the exhaust gas stream.

14. The feedback system of claim 12, wherein at least one of the gas analyzers is operative to determine the concentration of sulfur dioxide in the exhaust gas stream.

15. The feedback system of claim 7, wherein the emissions monitor comprises a spectrometer.

16. The feedback system of claim 7, wherein the controller unit includes a control valve to control the fluid connection between the second source and the oil burner in response to the signals from the emissions monitor.

17. The feedback system of claim 16, wherein the controller unit further includes a processor operative to compare the signals received from the emissions monitor to the predetermined threshold concentration and to generate signals for control of the control valve.

18. The feedback system of claim 17, wherein the controller unit further includes a transducer for converting electrical signals from the processor to pneumatic signals for the control valve.

19. The feedback system of claim 7, further comprising a mixer in the flow path for blending the lighter oil and the heavier oil prior to entering the oil burner.

* * * * *

UNITED STATES PATENT AND TRADEMARK OFFICE

CERTIFICATE OF CORRECTION

PATENT NO. : 5,263,850

DATED : November 23, 1993

INVENTOR(S) : Thomas J. Walker

It is certified that error appears in the above-indentified patent and that said Letters Patent is hereby corrected as shown below:

Column 1, line 32, ",or" should read --or--.

Column 3, line 12, "oil converts" should read --oil, converts--.

Column 4, line 22, "ma be" should read --may be--.

Column 4, line 36, "ga" should read --gas--.

Column 4, line 42, "room The" should read --room. The--.

Column 4, line 51, "for the" should read --for operating the--.

Signed and Sealed this

Thirtieth Day of August, 1994

*Attest:*

*Attesting Officer*

Bruce Lehman

BRUCE LEHMAN

*Commissioner of Patents and Trademarks*